US007865109B2

(12) United States Patent
Kobayashi

(10) Patent No.: US 7,865,109 B2
(45) Date of Patent: Jan. 4, 2011

(54) DEVELOPING APPARATUS AND IMAGE FORMING APPARATUS

(75) Inventor: Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 180 days.

(21) Appl. No.: 12/144,898

(22) Filed: Jun. 24, 2008

(65) Prior Publication Data

US 2009/0010676 A1 Jan. 8, 2009

(30) Foreign Application Priority Data

Jun. 25, 2007 (JP) ..... 2007-165843

(51) Int. Cl.
*G03G 15/08* (2006.01)

(52) U.S. Cl. ..... 399/103; 399/105

(58) Field of Classification Search ..... 399/91, 399/98, 102, 103, 105, 106, 111
See application file for complete search history.

(56) References Cited

U.S. PATENT DOCUMENTS 6,829,452 B2 * 12/2004 Tanimoto et al. ..... 399/98
6,937,831 B2 * 8/2005 Kamimura ..... 399/103
7,190,920 B2 * 3/2007 Okamoto ..... 399/103
7,206,535 B2 * 4/2007 Nozawa ..... 399/103

FOREIGN PATENT DOCUMENTS

JP 05-027574 2/1993

* cited by examiner

*Primary Examiner*—Hoan Tran
(74) *Attorney, Agent, or Firm*—Panitch Schwarze Belisario & Nadel LLP

(57) ABSTRACT

A developing apparatus is provided that can reliably prevent a developer from leaking even where the developing apparatus is continuously used, and an image forming apparatus having the developing apparatus is provided. The developing apparatus has a developer container for containing a developer, a developing portion for generating a developer image by developing an electrostatic latent image formed on an electrostatic latent image holder using the developer contained in the developer container, a seal member formed along a surface of an end portion of the developing portion for sealing between the developer container and the developing portion, and a supporting member for supporting the seal member so as to allow displacement.

19 Claims, 17 Drawing Sheets

DEVELOPING APPARATUS AND IMAGE FORMING APPARATUS

BACKGROUND OF THE INVENTION

1. Field of the Invention

The present invention relates to a developing apparatus and an image forming apparatus.

2. Description of Related Art

Japanese Laid-Open Patent Publication No. H5-27574 discloses a developing apparatus that develops a developer image and can prevent a developer from leaking out of a developer container.

Specifically, the developing apparatus disclosed in Publication No. H5-27574 has seal members disposed at both longitudinal ends of a developing roller and also has a blade. The seal members and the blade are integrally formed. Thus, the developing apparatus ensures a high sealing performance in the longitudinal direction of the developing roller.

SUMMARY OF THE INVENTION

There exists, however, a problem in use of such developing apparatus that as the developing roller rotates, the seal member is deformed and causes the developer to leak out of the developer container. Specifically, as the developing roller rotates, a frictional resistance between the developing roller and the seal member exerts a tensile force on a surface of the seal member in contact with the developing roller. Then, when the surface of the seal member in contact with the developing roller is pulled toward a rotational direction of the developing roller, a similar force emerges in the inside of the seal member, and the seal member is deformed such that the seal member is pulled toward a downstream side in the rotational direction. Thus, a density of the seal member increases at the downstream side in the rotational direction of the developing roller. Where the density of the seal member increases, a reaction force exerted from the seal member to the developing roller increases, and accordingly, a frictional force between the seal member and the developing roller increases. Therefore, this results in an increase of an abrasion amount of the seal member and also results in deterioration of the sealing performance between the seal member and the developing roller, thus causing the developer to leak out. Such problems conspicuously occurs especially in a case where a continuous use of the developing apparatus roughens surfaces of the developing roller and the seal member and increases the frictional resistance on the surfaces of the developing roller and the seal member.

This invention is made in consideration of such problems, and provides a developing apparatus capable of reliably preventing the developer from leaking even where the developing apparatus is continuously used, and also provides an image forming apparatus equipped with the developing apparatus.

In order to solve such problems as described above, a developing apparatus of the present invention has a developer container for containing a developer, a developing portion for generating a developer image by developing an electrostatic latent image formed on an electrostatic latent image holder using the developer contained in the developer container, a seal member formed along a surface of an end portion of the developing portion for sealing between the developer container and the developing portion, and a supporting member for supporting the seal member so as to allow displacement.

The developing apparatus as structured above can prevent an increase of a reaction force exerted by the seal member to the developing portion due to an increase in the density of the seal member, because the seal member is displaced even where the seal member is deformed by being pulled toward a downstream side in a rotational direction of the developing portion. Thus, the developing apparatus can prevent an increase of a frictional resistance between the seal member and the developing portion while maintaining a sealing performance between the seal member and the developing portion.

An image forming apparatus of the present invention has the developing apparatus as described above, a transfer device for transferring the developer image developed by the developing apparatus onto a predetermined recording medium, and a fusing device for fusing the developer image transferred to the recording medium by the transfer device to fix the developer image to the recording medium.

The image forming apparatus as structured above can prevent the developer from leaking from the developing apparatus, thus preventing the developer leaked out of the developing apparatus from adhering to the recording medium. Further, the image forming apparatus can form a high quality image on the recording medium.

As described above, the developing apparatus of the present invention reliably prevents the developer from leaking even where the developing apparatus is continuously used.

The image forming apparatus of the present invention can prevent the developer from leaking and thus can form a high quality image on a recording medium.

DETAILED DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

PREFERRED EMBODIMENTS

A specific embodiment according to the present invention is hereinafter described in detail with reference to figures.

In the first embodiment of the present invention, the present invention is described in detail using a electrophotographic color printer as an example of an image forming apparatus.

Figure 1:
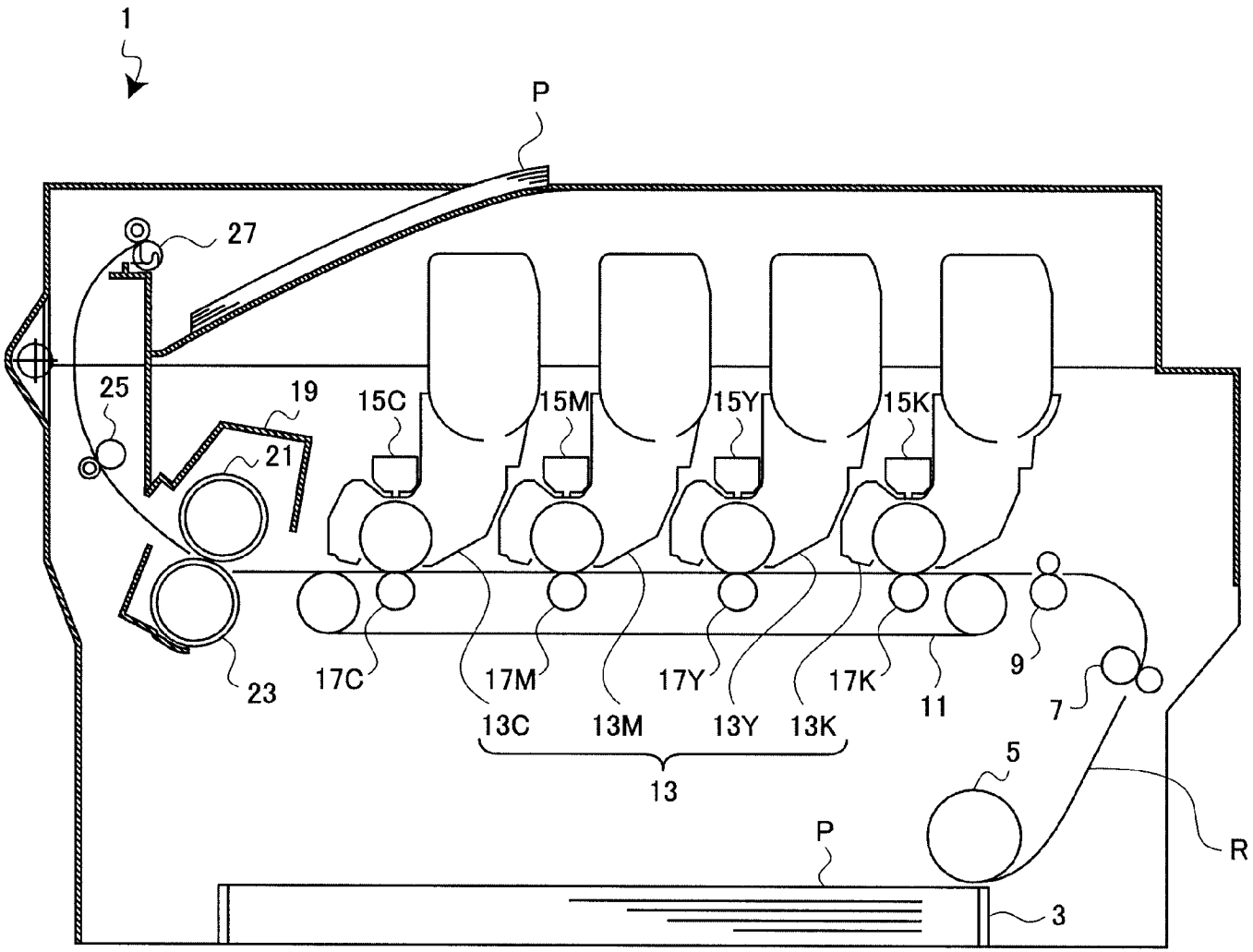
FIG. 1 is a cross sectional diagram of a printer according to the first embodiment of the present invention for describing a structure of the printer.

As shown in FIG. 1, a printer 1 has a paper tray 3 containing a recording medium such as paper, and also has a feeding roller 5 picks up a paper P contained in the paper tray 3 and feed the paper P in a downstream direction in a medium conveyance route R. When a series of printing operation starts, the printer 1 drives the feeding roller 5 to feed the paper P in the downstream direction in the medium conveyance route R. Conveyance rollers 7 and 9 convey the paper P fed by the feeding roller to a conveyance device 11 disposed downstream in the medium conveyance route R.

The conveyance device 11 conveys the paper P along the medium conveyance route R when a transfer processing is performed to transfer a developer image developed by a developing apparatus 13 onto the paper P.

The developing apparatus 13 develops an electrostatic latent image formed based on inputted image information and forms a developer image at an appropriate timing of conveyance of the paper P. Specifically, the printer 1 has a developing apparatus 13C forming a developer image in cyan, a developing apparatus 13M forming a developer image in magenta, a developing apparatus 13Y forming a developer image in yellow, and a developing apparatus 13K forming a developer image in black. The developing apparatus 13C, 13M, 13Y, and 13K are disposed in combination with later-described exposure devices 15C, 15M, 15Y, and 15K, respectively, that form electrostatic latent images on a photosensitive drum. Each of the developing apparatus 13C, 13M, 13Y, and 13K forms a developer image on an electrostatic latent image formed by a corresponding one of the exposure devices 15C, 15M, 15Y, and 15K. Then, each of the developer images developed by the developing apparatus 13C, 13M, 13Y, and 13K is transferred, one by one, onto the paper P in sequence. Thereafter, the conveyance device 11 conveys the paper P having the developer image transferred thereon to a fusing device 19 disposed downstream in the medium conveyance route R.

The fusing device 19 fuses the developer image transferred to the paper P to fix the developer image onto the paper P. Specifically, the fusing device 19 has a fusing roller 21 including a heat source such as a halogen lamp, not shown, disposed inside of the fusing roller 21, and also has a pressure roller 23 pressed against the fusing roller 21. The fusing device 19 conveys the paper P while sandwiching the paper P between the fusing roller 21 and the pressure roller 23, so that the developer image transferred to the paper P is fused and fixed onto the paper P by a heat supplied by the heat source and a pressing force exerted by the pressure roller 23.

Discharge rollers 25 and 27 convey the paper P discharged from the fusing device 19 to the downstream direction of the medium conveyance route R and discharge the paper P to the outside of the image forming apparatus. Thus, the printer 1 provides a user with the paper P printed with the developer image based on the inputted image information.

Figure 2:
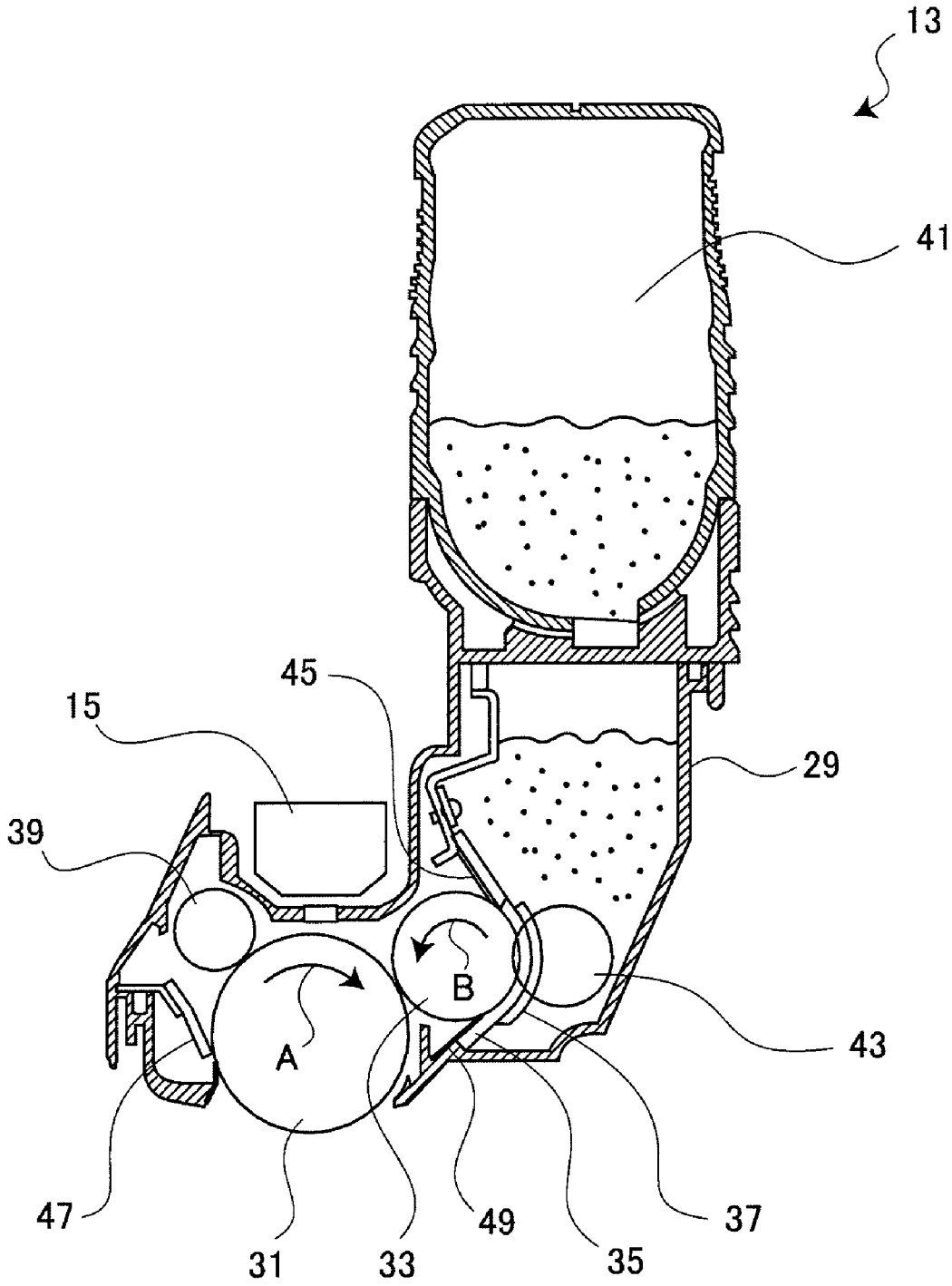
FIG. 2 is a cross sectional diagram showing a developing apparatus of the printer and describing a structure of the developing apparatus.

A structure of the developing apparatus 13 is hereinafter described in detail with reference to FIG. 2. It should be noted that each of the developing apparatus 13C, 13M, 13Y, and 13K has the same structure, and accordingly, those developing apparatus are referred to as the developing apparatus 13 representing each of the developing apparatus 13C, 13M, 13Y, and 13K. The developing apparatus 13 is hereinafter described in detail.

The developing apparatus 13 has a developer container 29 containing a developer, a developing roller 33 forming a developer image on an electrostatic latent image formed on a photosensitive drum 31 by developing the electrostatic latent image with the developer contained in the developer container 29, a seal member 35 disposed along circumferential surfaces of end portions of the developing roller 33 for sealing between the developer container 29 and the developing roller 33, and a seal supporting member 37 supporting the seal member 35 so as to allow displacement. When the developing apparatus 13 as described above generates the developer image, the developing apparatus 13 uniformly charges a surface of the photosensitive drum 31 rotating in the direction of the arrow A with the charging roller 39. Then, the exposure device 15 drives a light emitting device, not shown, based on the inputted image information, and forms the electrostatic latent image on the photosensitive drum 31 having been charged. In synchronization with the above operation, the developing apparatus 13 uses a supply roller 43 to feed the developer, supplied from a developer cartridge 41 detachably disposed on the developing apparatus 13, toward the direction of the developing roller 33. Then, the developing roller 33 supplied with the developer rotates in the direction of the arrow B while holding the developer. At this moment, the developer held by the developing roller 33 is smoothed out into a thin film form by a developing blade 45 arranged to press the developing roller 33. Thereafter, the developing roller 33 caused the smoothed developer to adhere onto the electrostatic latent image formed on the surface of the photosensitive drum 31. Thus, the developing apparatus 13 develops the electrostatic latent image and generates the developer image based on the inputted image information. Then, when the developer image is transferred to the paper P, the developer remaining on the photosensitive drum 31 is scraped off by a cleaning blade 47.

The developing roller 33 is structured by forming a rubber roll portion on a circumferential surface of a pillar body having an axis substantially perpendicular to the medium conveyance route R. The developing roller 33 as described above is disposed at a predetermined position in the developer container 29. In the developer container 29, various kinds of sealing members are formed to prevent the developer from leaking to the outside of the developer container 29 from around the developing roller 33. Specifically, a seal film 49 is formed below the developing roller 33 to prevent the developer from leaking to the outside of the developer container 29 from below the developing roller 33. The seal film 49 generally has the same length as a longitudinal length of the developing roller 33, and is formed to press against the rubber roll portion of the developing roller 33. The seal film 49 is formed with, for example, a urethane film having resilient force 1 $g/mm^2$ exerted against pushing force, and the seal film 49 prevents the developer from leaking to a direction perpendicular to a direction of a rotational axis of the developing roller 33. A sponge member 51 is formed in the developer container 29 to prevent the developer from leaking to the direction of the rotational axis of the developing roller 33. The sponge member 51 is formed on generally all over a sidewall 53 of the developer container 29 to prevent the developer from leaking from side portions of the developer container 29.

Figure 3:
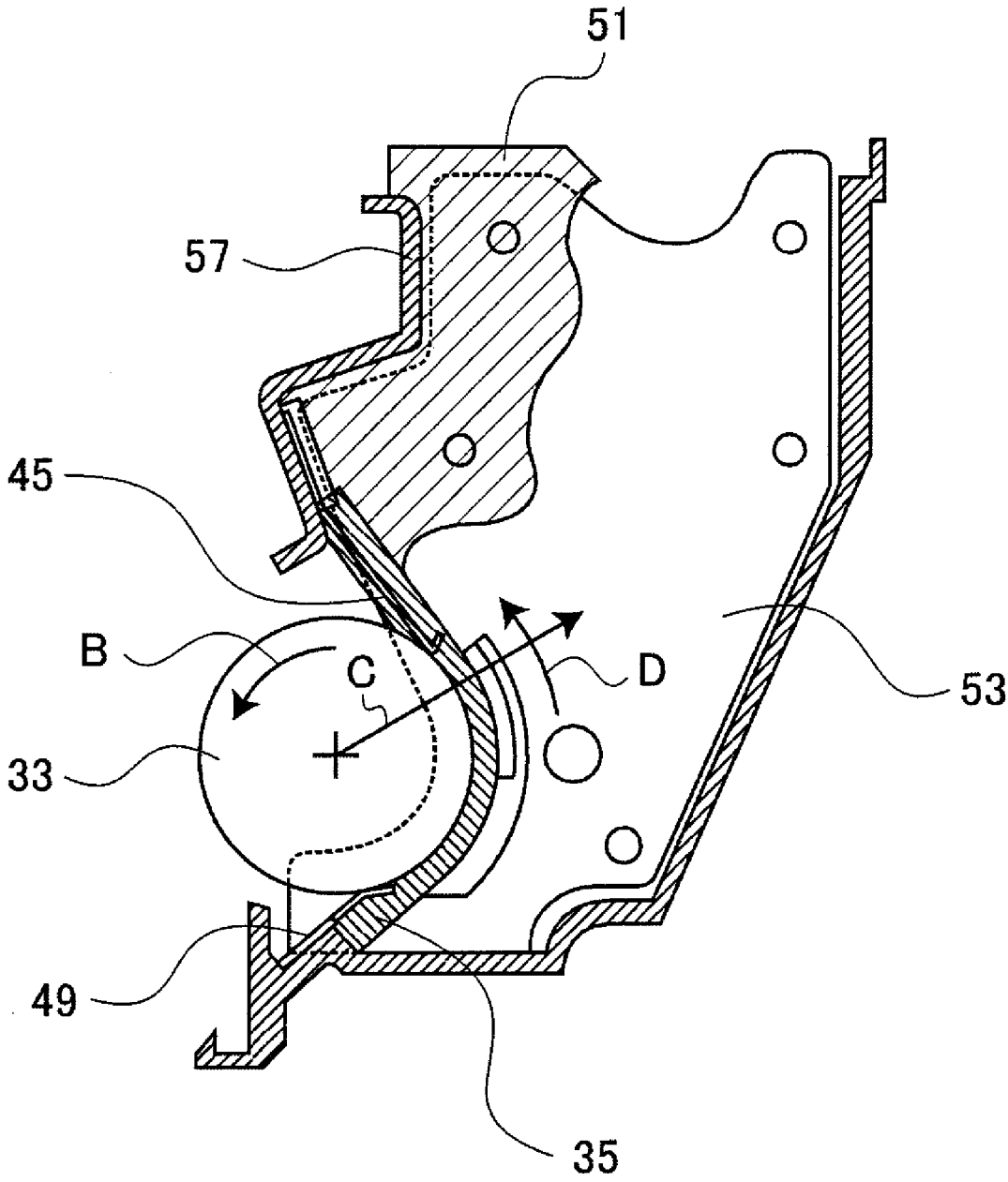
FIG. 3 is an enlarged cross sectional diagram showing an important portion of the developing apparatus and describing a structure of the developing apparatus.
Figure 4:
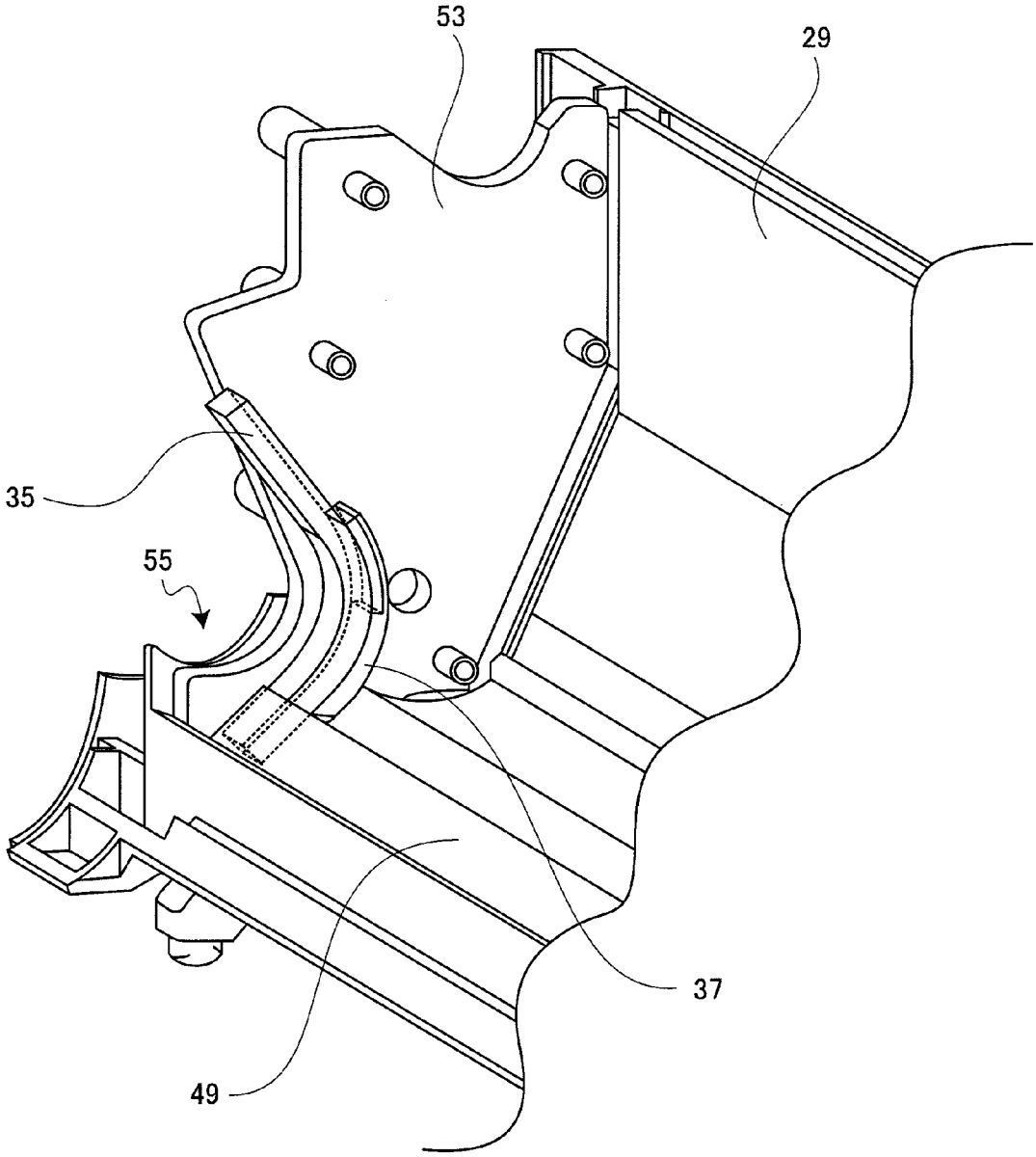
FIG. 4 is an enlarged perspective view showing the important portion of the developing apparatus and describing the structure of the developing apparatus.

The seal member 35 is formed in the developer container 29 to seal between the developing roller 33 and the developer container 29. The seal member 35 is formed along the circumferential surfaces of both end portions of the developing roller 33 to seal between the developer container 29 and the developing roller 33. As shown in FIGS. 3 and 4, the sidewall 53 of the developer container 29 has a shaft, not shown, for the developing roller 33, and also has an opening portion 55 allowing the developing roller 33 to connect to a driving source for supplying driving force to the developing roller 33. The seal member 35, which is different from the sponge member 51, is formed in proximity to the opening portion 55 of the sidewall 53 of the developer container 29 to prevent the developer from leaking.

The seal member 35 is formed to be in close contact with the sidewall 53. The seal member 35 is formed along peripheral portions of the opening portion 55, and ranges from the seal film 49 to a blade supporting portion 57 supporting the developing blade 45. The seal member 35 as described above is formed with a material having a predetermined elasticity, for example, a urethane sponge and the like. A film for reducing a friction between the developing roller 33 and the seal member 35, for example, a film made with Teflon (registered trademark) and the like, is adhered to a surface of the seal member 35 in contact with the developing roller 33. One end of the seal member 35 is fixed to a proximity of the blade supporting portion 57, and the other end thereof is fixed to a proximity of the seal film 49. When the developing roller 33 is attached to the developing apparatus 13, a surface of the seal member 35 having the film attached thereto is arranged at a position to be in close contact with the circumferential surface of the developing roller 33. The seal member 35 is supported by the seal supporting member fixed to the sidewall 53.

The seal supporting member 37 supports the seal member 35 so as to allow displacement. It should be noted that supporting the seal member 35 so as to allow displacement means that supporting the seal member 35 so as to allow the seal member 35 to displace in a direction away from a rotational center of the developing roller 33 and allow the seal member 35 to displace toward a rotational direction of the developing roller 33 when the seal member 35 is pulled by the rotation of the developing roller 33. That is, as shown in FIG. 3, the seal supporting member 37 supports the seal member 35 so as to allow the seal member 35 to displace toward the direction of the arrow C pointing in a direction away from the rotational center of the developing roller 33 and to displace toward the direction of the arrow D which is the same direction as the arrow B pointing to the rotational direction of the developing roller 33. The seal supporting member 37 is formed on all over a back surface opposite to a portion of the seal member 35 in contact with the developing roller 33 so that the seal supporting member 37 is pressed by the seal member 35.

Figure 5:
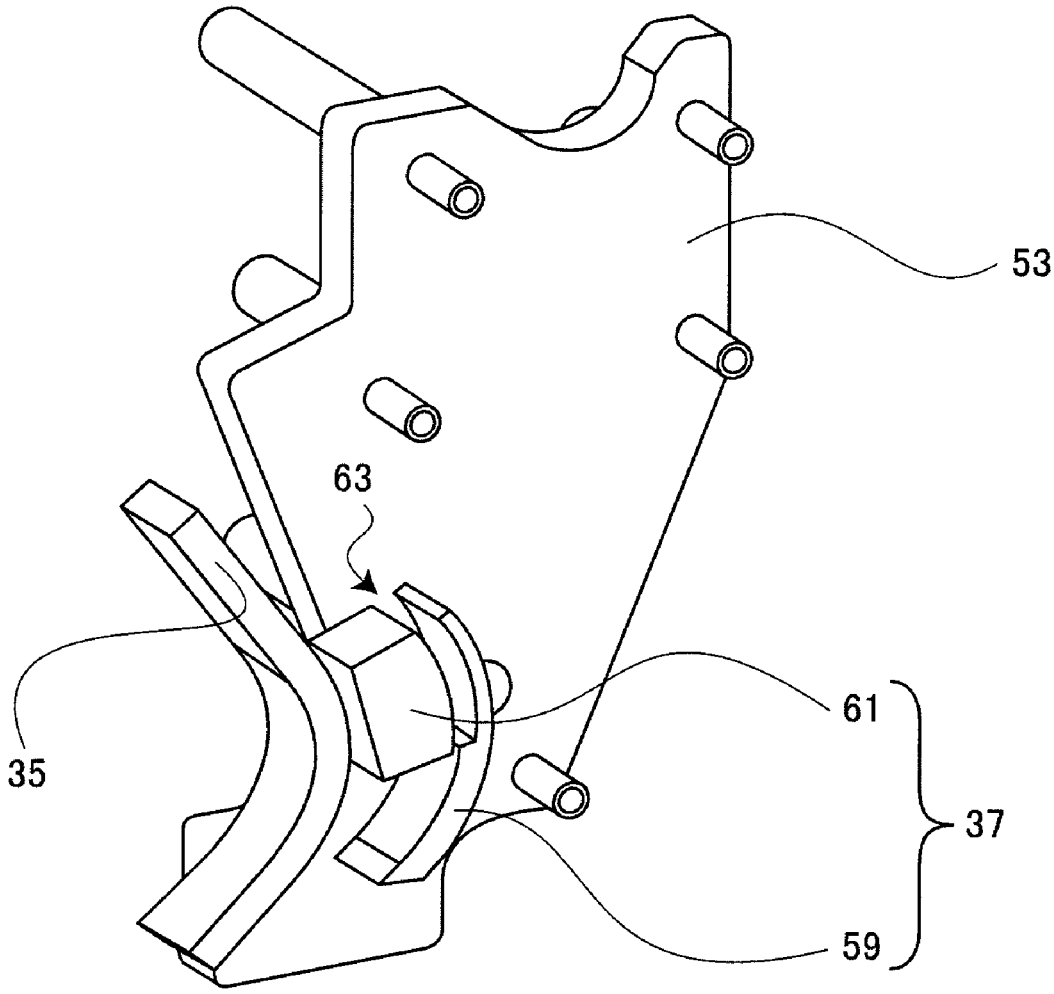
FIG. 5 is an enlarged exploded perspective view showing the important portion of the developing apparatus and describing the structure of the developing apparatus.

The seal supporting member 37 as described above has a supporting base 59 and an assisting sponge 61 as shown in FIG. 5. The assisting sponge 61 is formed to be able to deform when the seal member 35 exerts force larger than a certain level on the assisting sponge 61. Specifically, the assisting sponge 61 is formed with, for example, an elastic material having elastic force less than the seal member 35 and having resilient force 0.5 $g/mm^2$ exerted against pushing force. When a portion of the seal member 35 is deformed toward the direction of the arrow C and the seal member 35 exerts force larger than a certain level on the assisting sponge 61, the assisting sponge 61 deforms to reduce reaction force exerted by the assisting sponge 61 on the seal member 35. The supporting base 59 supports the assisting sponge 61. The supporting base 59 as described above is formed to have a curvature corresponding to a shape of the developing roller 33, and is fixed to the sidewall 53. A portion of the supporting base 59 is in contact with a portion of the seal member 35, and fixes the seal member 35. The supporting base 59 has a recess portion 63 accommodating the assisting sponge 61. The recess portion 63 is formed on an upper portion of a surface of the supporting base 59 in contact with the seal member 35, and is formed in a shape corresponding to a shape of the assisting sponge 61. The assisting sponge 61 is compressed and accommodated in the recess portion 63 when the developing roller 33 is attached to the developing apparatus 13. At this moment, the assisting sponge 61 is accommodated to be able to deform in the rotational direction of the developing roller 33. The seal supporting member 37 as described above is made to have a predetermined elasticity at an upper portion of the surface of the seal supporting member 37 in contact with the seal member 35, namely, a portion corresponding to a downstream side of the rotation of the developing roller 33, and is made to fix the seal member 35 at a lower portion thereof, namely, a portion corresponding to an upstream side of the rotation of the developing roller 33.

Figure 6:
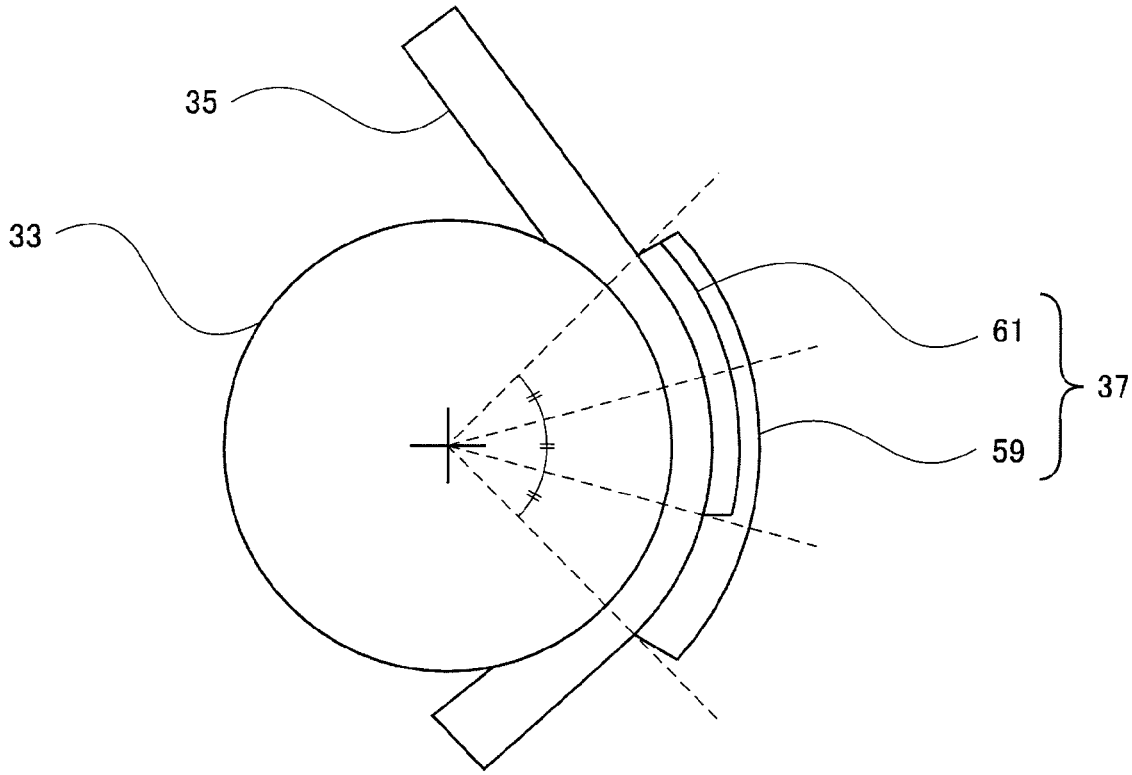
FIG. 6 is an enlarged cross sectional diagram showing the important portion of the developing apparatus and describing a positional relationship between each member.

A positional relationship between the developing roller 33, the seal member 35, and the seal supporting member 37 is preferred to be configured as follows. As described above, the seal supporting member 37 is formed to correspond to a contact portion between the developing roller 33 and the seal member 35, and it is preferable that the assisting sponge 61 is formed to occupy approximately two thirds of the seal supporting member 37 at the downstream side in the rotational direction of the developing roller 33 as shown in FIG. 6. Accordingly, the seal member 35 is in contact with the seal supporting member 37 in one third of the entire contacting portion between the seal member 35 and the seal supporting member 37, and the seal member 35 is in contact with the assisting sponge 61 in two thirds therein. In this way, the assisting sponge 61 is disposed to correspond to an easily deformed portion of the seal member 35, namely, the downstream side in the rotational direction of the developing roller 33, and thus, the seal member 35 is reliably fixed to the seal supporting member 37 and also prevented from deforming.

Figure 7:
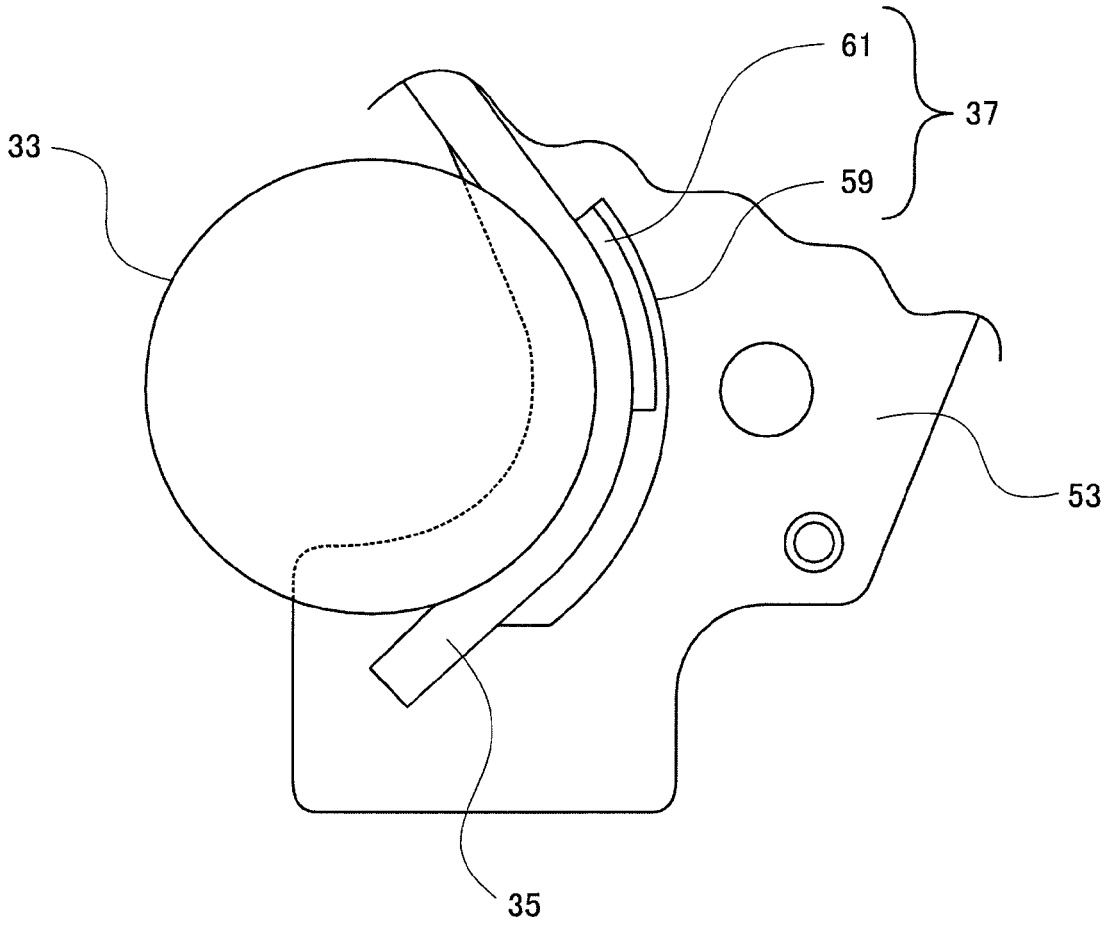
FIG. 7 is an enlarged cross sectional diagram showing the important portion of the developing apparatus and describing operation of the developing apparatus.

When the developing roller 33 is attached to the developing apparatus 13 but the developing apparatus 13 is not operating, each unit of the developing apparatus 13 as described above becomes as shown in FIG. 7. Specifically, the assisting sponge 61 is accommodated in the recess portion 63, and the seal member 35 is located between the seal supporting member 37 and the developing roller 33. At this moment, a reaction force exerted to each other at the contacting portion between the seal member 35 and the developing roller 33 becomes substantially uniform throughout the entire contacting portion.

At this moment, where the developing roller 33 is relatively new, a frictional resistance is relatively low between the surface of the developing roller 33 and the surface of the seal member 35. Accordingly, a large amount of frictional force is not exerted to the seal member 35 even where the developing roller 33 drives, and the seal member 35 does not deform while the seal member 35 is in close contact with the developing roller 33.

Figure 8:
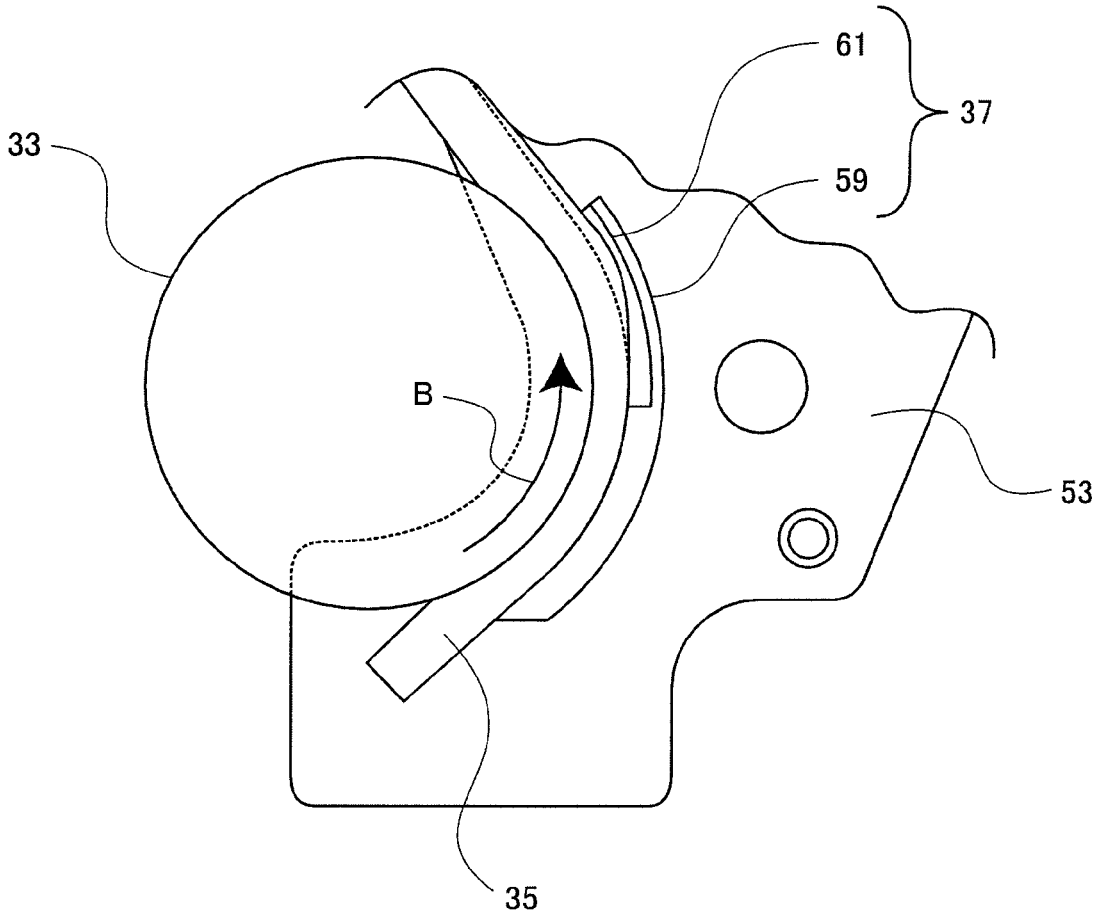
FIG. 8 is an enlarged cross sectional diagram showing the important portion of the developing apparatus and describing operation of the developing apparatus.

However, where the developing roller 33 is continuously used, the surface of the developing roller 33 and a contacting surface between the seal member 35 and the developing roller 33 are roughened, and accordingly, the frictional resistance between the developing roller 33 and the seal member 35 increases. Where the frictional resistance between the developing roller 33 and the seal member 35 increases, a tensile force occurs on the surface of the seal member 35 due to the frictional resistance. Where the tensile force on the surface of the seal member 35 exceeds a certain value, a portion of the seal member 35 is compressed and an internal density increases because both ends of the seal member 35 are fixed. Where the internal density of the seal member 35 increases, a force exerted by the seal member 35 to the developing roller 33 and a force exerted by the seal member 35 to the seal supporting member 37 increase. Where the force exerted by the seal member 35 to the seal supporting member 37 increases, the assisting sponge 61 is further compressed by the force exerted by the seal member 35 as shown in FIG. 8. When the force exerted by the seal member 35 to the assisting sponge 61 is absorbed by a deformation of the assisting sponge 61, the force exerted by the seal member 35 on the developing roller 33 decreases by an amount absorbed by the assisting sponge 61, compared with a case where the developing apparatus 13 does not have the seal supporting member 37. Therefore, in the present invention, the seal supporting member 37 causes a portion of the seal member 35 to deform, thus capable of preventing an increase in the force exerted by the seal member 35 to the developing roller 33. When the developing roller 33 stops its driving, a resilience of the assisting sponge 61 returns the seal member 35 back to its original state.

When the force exerted by the developing roller 33 to the seal member 35 increases, the developing roller 33 causes a shearing stress in a longitudinal direction of the seal member 35. However, the assisting sponge 61 is fixed to a surface of the seal member 35 opposite to the surface thereof in contact with the developing roller 33, and the assisting sponge 61 is fixed to the supporting base 59 so as to allow displacement in the rotational direction of the developing roller 33. Thus, the assisting sponge 61 can absorb minute displacement occurring in the seal member 35 in the rotational direction of the developing roller 33.

In this way, the developing apparatus 13 according to the first embodiment of the present invention can keep the pressing force exerted by the seal member 35 to the developing roller 33 constant even where the frictional resistance between the seal member 35 and the developing roller 33 increases over time. Accordingly, the developing apparatus 13 can reliably prevent the developer from leaking from the developer container 29, and further, can prevent the seal member 35 from wearing down by preventing the pressing force exerted by the seal member 35 to the developing roller 33 from exceeding a configured value.

The printer 1 according to the first embodiment of the present invention can prevent the developer from leaking from the developing apparatus 13 and from adhering to the paper P, thus capable of providing a high quality image.

Figure 9:
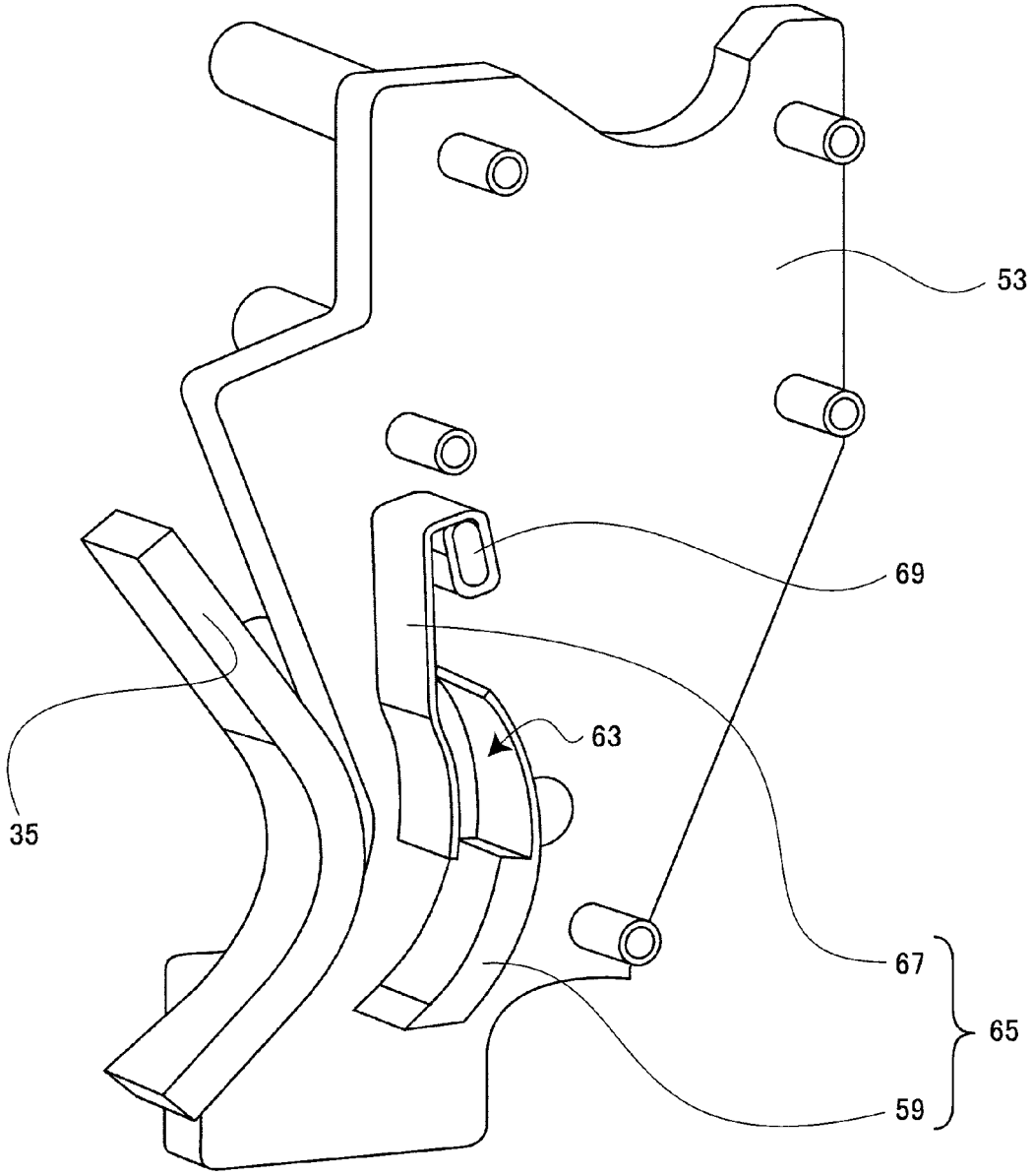
FIG. 9 is an enlarged perspective view showing the important portion of a modified example of the developing apparatus and describing a structure of the developing apparatus.

A structure shown in FIG. 9 can be used as a structure of the seal supporting member.

Figure 10:
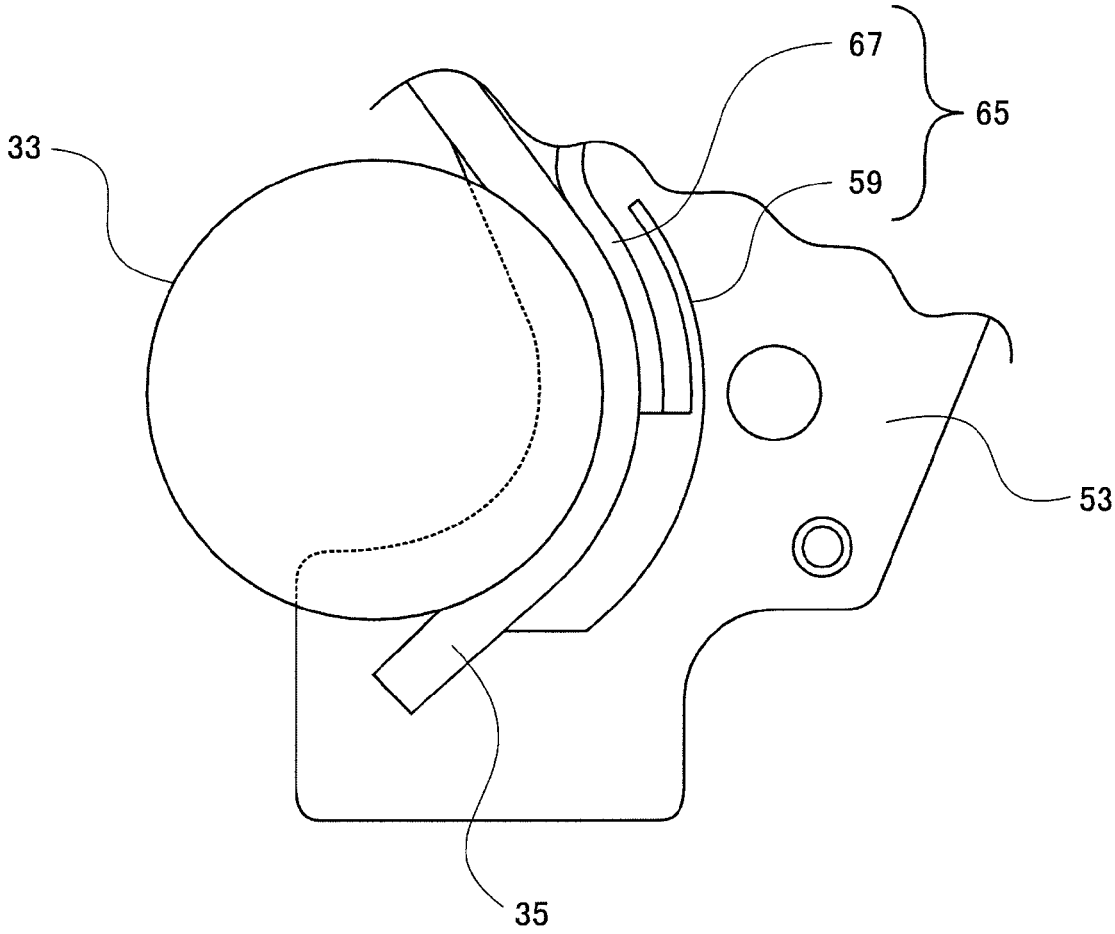
FIG. 10 is an enlarged cross sectional diagram showing the important portion of the developing apparatus and describing operation of the developing apparatus.
Figure 11:
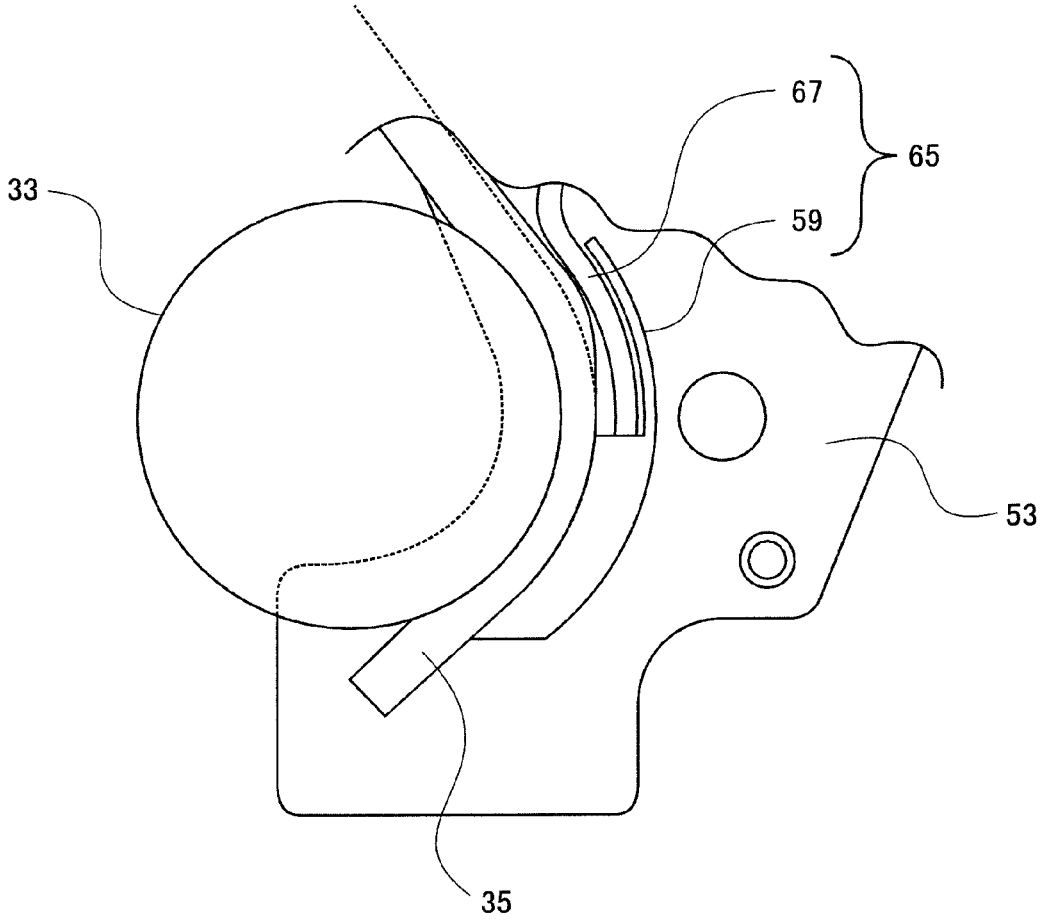
FIG. 11 is an enlarged cross sectional diagram showing the important portion of the developing apparatus and describing operation of the developing apparatus.

As shown in FIG. 9, the seal supporting member 65 has a spring 67 in place of the assisting sponge 61. For example, the spring 67 is a flat spring, one end of which is fixed to a fixing portion 69 disposed above the seal supporting member 65, and the other end of the flat spring is bent according to a shape of the recess portion 63 of the supporting base 59. The spring 67 is arranged to provide an urging force in a direction from the supporting base 59 to the seal member 35, and a clearance is formed between the spring 67 and a backwardly bent surface of the supporting base 59. When the developing roller 33 is attached to the developing apparatus 13, the spring 67 comes in contact with the seal member 35 and urges the seal member 35 in a direction of the developing roller 33 as shown in FIG. 10. When the shape of the seal member 35 deforms, the spring 67 moves in a direction to come in contact with the supporting base 59 and absorbs the deformation of the seal member 35 as shown in FIG. 11. When the developing roller 33 stops, a resilience of the spring 67 returns the seal member 35 back to its original state.

As described above, the seal supporting member of the developing apparatus of the present embodiment can be any structure as long as the seal supporting member can support the seal member 35 so as to allow displacement and can restore the seal member 35 back to its original position where the developing roller 33 stops. Accordingly, the seal supporting member is not limited to the structure using the assisting sponge 61 or the spring 67 as described above.

In the first embodiment, the developing apparatus having the developing roller serving as a developing portion is described, but the image forming apparatus may have a developing belt in place of the developing roller. The developing belt serves as the developing portion just as the developing roller does.

The second embodiment of the present invention is hereinafter described in detail. Some portions of the developing apparatus according to the second embodiment have the same structure as those of the developing apparatus 13 according to the first embodiment. The same reference numerals as the first embodiment are given to those portions of the second embodiment that have the same structure as the first embodiment, and the detailed description thereabout is omitted. Only different portions are hereinafter described in detail.

Figure 12:
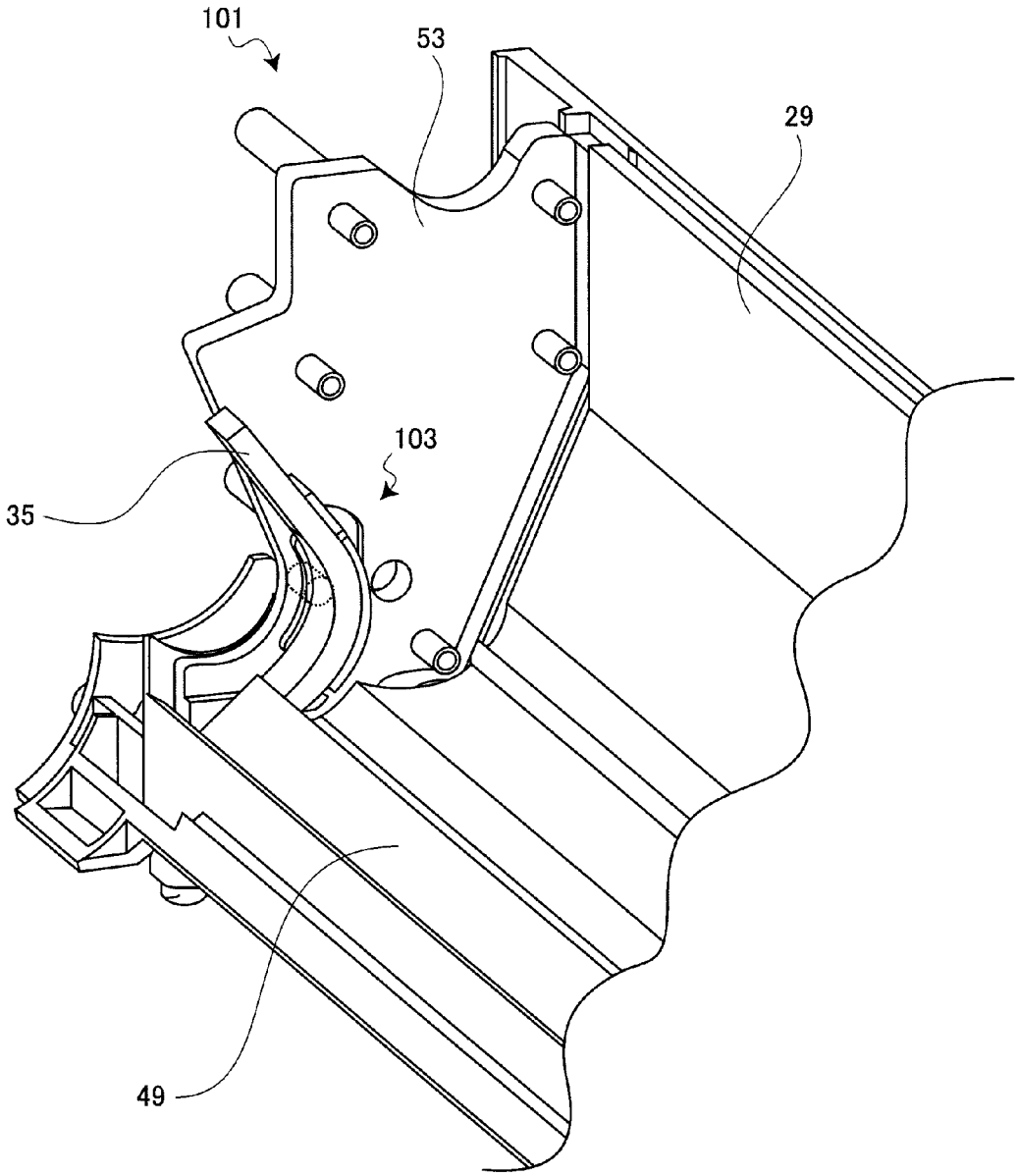
FIG. 12 is a perspective view showing the important portion of the developing apparatus according to the second embodiment and describing a structure of the developing apparatus.

As shown in FIG. 12, the developing apparatus 101 has a seal supporting member 103 in place of the seal supporting member 37. The seal supporting member 103 is formed to be able to rotate about an axis generally parallel to the rotational axis of the developing roller 33.

The seal supporting member 103 is formed to be able to rotate about the axis generally parallel to the rotational axis of the developing roller 33 while supporting the seal member 35. Specifically, when the density of a portion of the seal member 35 increases, the force exerted by the seal member 35 to the seal supporting member 103 increases, and the increased force causes the seal supporting member 103 to rotate about the predetermined axis. Then, when the seal supporting member 103 rotates, a reaction force exerted by the seal supporting member 103 to the seal member 35 decreases, and thus, the rotation of the seal supporting member 103 can prevent an increase in a reaction force exerted by the seal member 35 to the developing roller 33.

Figure 13:
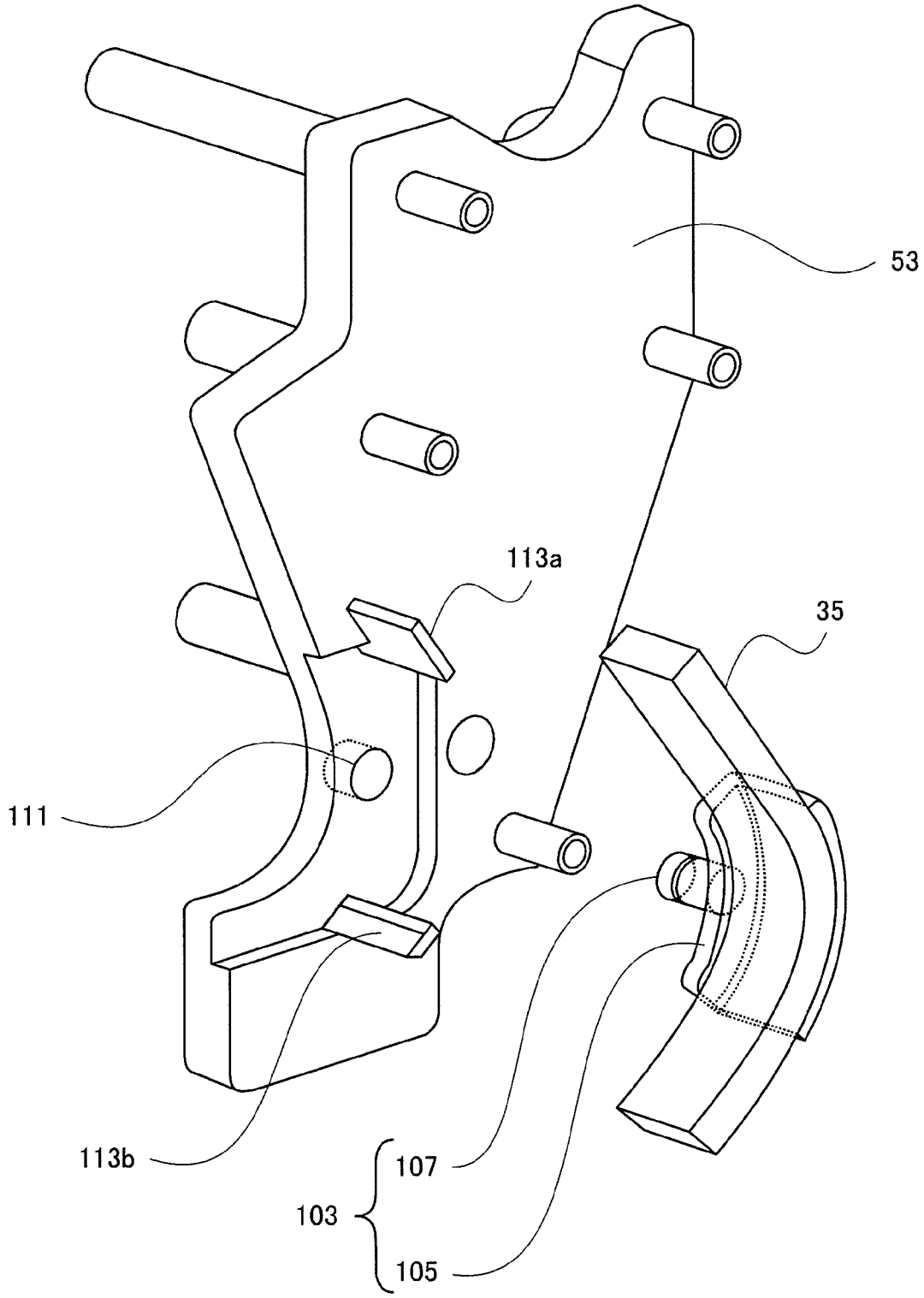
FIG. 13 is an enlarged exploded perspective view showing the important portion of the developing apparatus and describing a structure of the developing apparatus.

The seal supporting member 103 as described above has a supporting base 105 supporting the seal member 35 and a shaft 107 serving as a rotational axis of the seal supporting member 103 as shown in FIG. 13. The supporting base 105 supports the seal member 35 using a seal supporting surface having a curvature corresponding to the shape of the developing roller 33. The seal member 35 is adhered to the entire seal supporting surface of the supporting base 105 as described above. The shaft 107 is formed to extend from a sidewall 109 formed on a side of the supporting base 105, toward a direction opposite to the seal supporting surface. The shaft 107 as described above has an axis generally parallel to the seal supporting surface. The seal supporting member 103 as described above is rotationally supported by the sidewall 53 via a shaft receiving hole 111 formed on the sidewall 53.

The shaft receiving hole 111 is a hole penetrating the sidewall 53, and the shaft receiving hole 111 rotationally supports the shaft 107. When the shaft 107 is inserted to the shaft receiving hole 111, the shaft 107 reaches the opposite side of the sidewall 53 via the shaft receiving hole 111. A supporting fixture, for example, an E-shaped retaining ring, is fixed to an end of the shaft 107 reaching the opposite side of the sidewall 53. Thus, the shaft 107 is supported by the shaft receiving hole 111 to be able to rotate.

Figure 14:
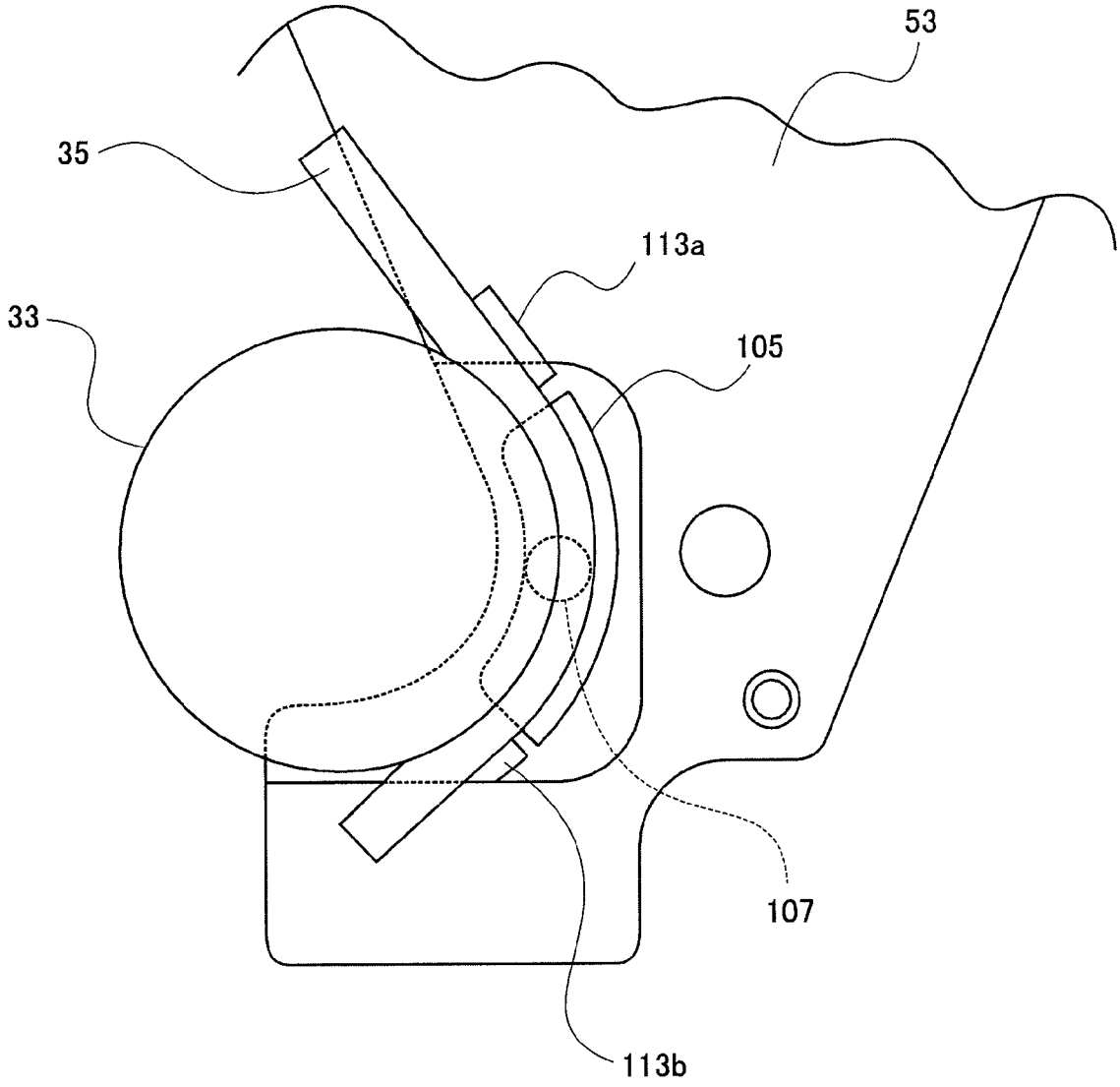
FIG. 14 is an enlarged cross sectional diagram showing the important portion of the developing apparatus and describing a positional relationship between each member.

Further, the sidewall 53 has a seal adhering surfaces 113*a*, 113*b* at each of above and below the shaft receiving hole 111. The seal adhering surfaces 113*a*, 113*b* are formed integrally with the sidewall 53. When the seal supporting member 103 is attached, the seal adhering surfaces 113*a*, 113*b* are formed at such positions that a certain clearance is formed between the seal supporting member 103 and the seal adhering surfaces 113*a*, 113*b* as shown in FIG. 14. A portion of a surface of the seal member 35 opposite to a surface thereof in contact with the developing roller 33 is adhered to a surface of the seal adhering surface 113*a* formed above the seal supporting member 103. The portion of the surface of the seal member 35 adhered to the seal adhering surface 113*a* is a downstream side, in the rotational direction of the developing roller 33, of the seal member 35 with respect to a portion to which the seal supporting member 103 is adhered. On the other hand, a portion of the surface of the seal member 35 opposite to the surface thereof in contact with the developing roller 33 is adhered to a surface of the seal adhering surface 113*b* formed below the seal supporting member 103. The portion of the surface of the seal member 35 adhered to the seal adhering surface 113*b* is a upstream side, in the rotational direction of the developing roller 33, of the seal member 35 with respect to the portion to which the seal supporting member 103 is adhered. In this way, portions of the upstream side and the downstream side of the seal member 35 in the rotational direction of the developing roller 33 are supported by the seal adhering surfaces 113*a*, 113*b* integrally formed with the sidewall 53, and a portion between the portions supported by the seal adhering surfaces 113*a*, 113*b* is supported by the seal supporting member 103 rotationally supported by the side wall 53.

A positional relationship between the developing roller 33, the seal member 35, and the seal supporting member 103 as described above is preferred to be configured as follows.

Figure 15:
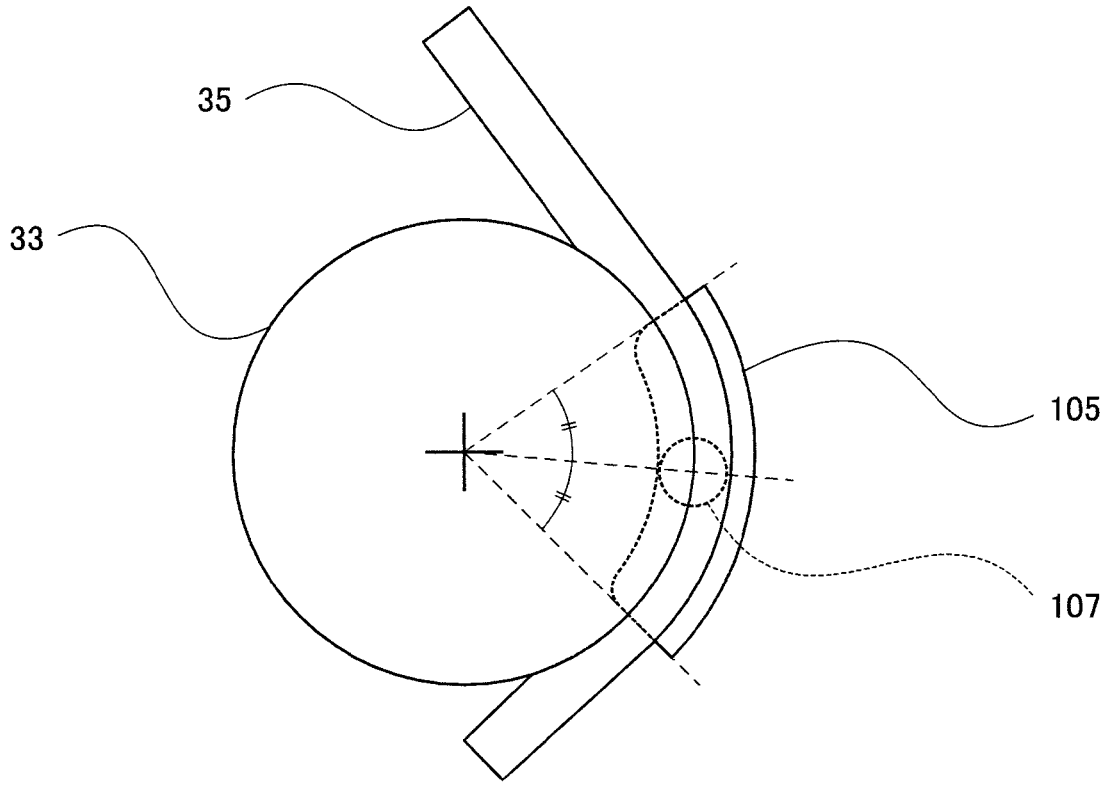
FIG. 15 is an enlarged cross sectional diagram showing the important portion of the developing apparatus and describing the positional relationship between each member.

As described above, the seal supporting member 103 is formed to correspond to a portion in which the developing roller 33 and the seal member 35 are in contact with each other. As shown in FIG. 15, the shaft receiving hole 111 is preferred to be formed at the generally middle of a portion of the circumference of the developing roller 33 corresponding to the portion in which the seal supporting member 103 and the seal member 35 are in contact with each other. In this way, the shaft receiving hole 111 is formed at a position dividing a contacting portion between the developing roller 33 and the seal member 35 into two equal portions, so that the developing roller 33 and the seal member 35 are in contact with each other uniformly both in the upstream side and in the downstream side with respect to the shaft receiving hole 111 in the rotational direction of the developing roller 33.

Further, an end portion of the seal supporting member 103 at the upstream side in the rotational direction of the developing roller 33 is preferred to be formed to correspond to a position of the seal member 35 subject to the most severe wear. The end portion of the seal supporting member 103 moves about the shaft 107 for a farthest distance. Such arrangement of the end portion of the seal supporting member 103 corresponding to the position of the seal member 35 subject to the most severe wear prevents an increase in frictional force between the seal member 35 and the developing roller 33 at the position subject to the most severe wear.

Figure 16:
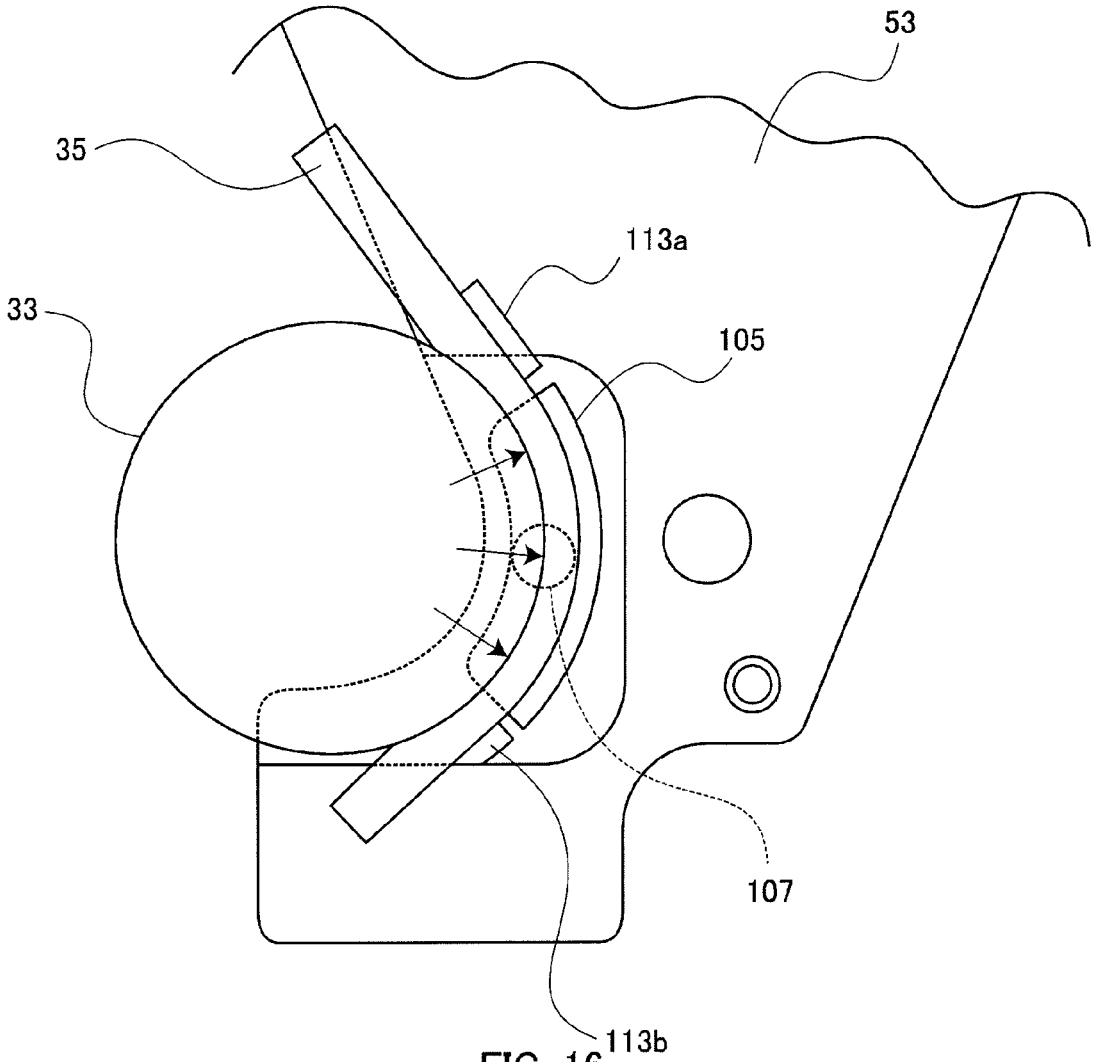
FIG. 16 is an enlarged cross sectional diagram showing the important portion of the developing apparatus and describing operation of the developing apparatus.
Figure 17:
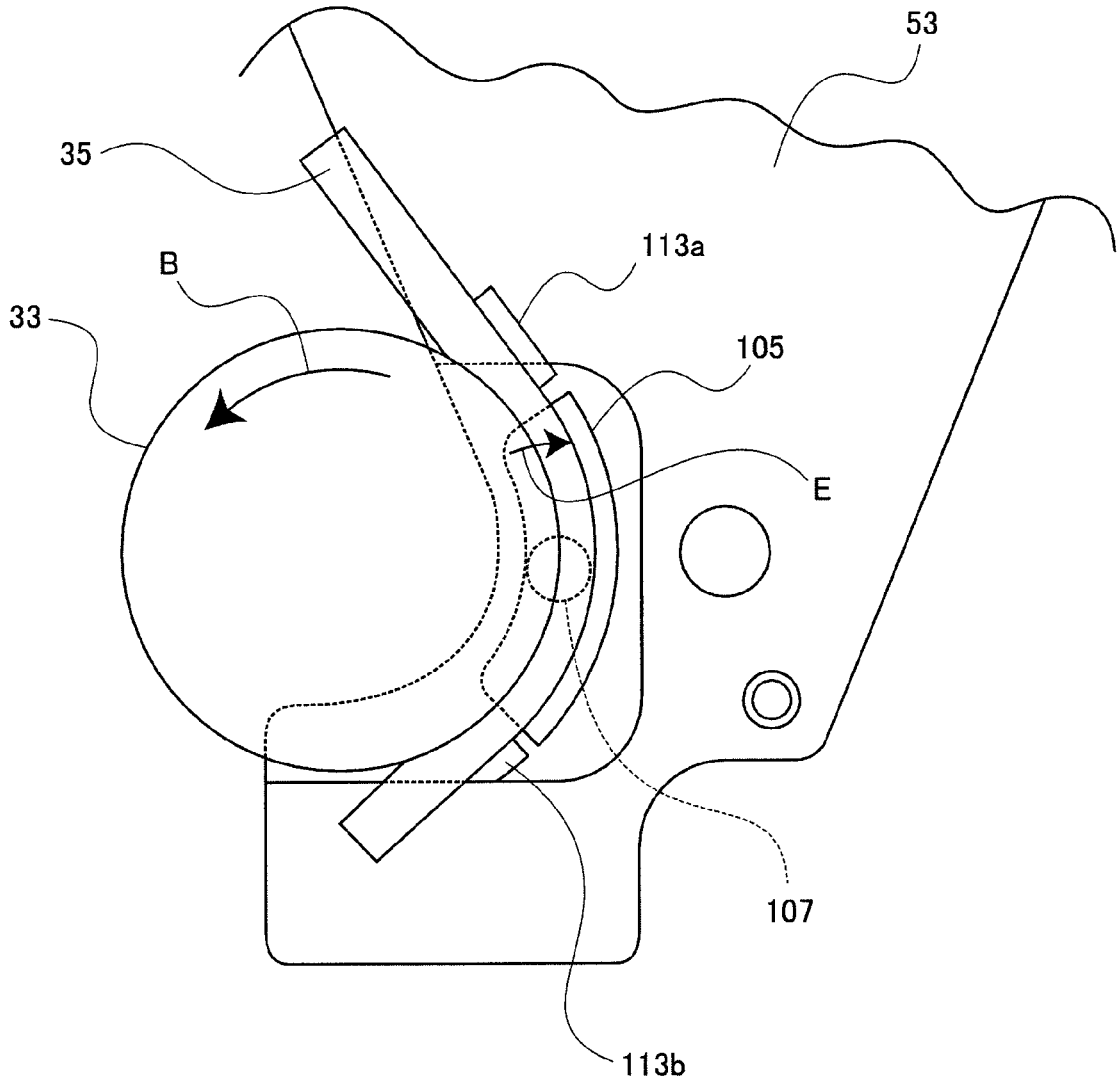
FIG. 17 is an enlarged cross sectional diagram showing the important portion of the developing apparatus and describing operation of the developing apparatus.

FIG. 16 shows the developing apparatus as described above, when the developing roller 33 is attached to the developing apparatus. That is, when the developing roller 33 is attached, the entire surface of the contacting portion between the developing roller 33 and the seal member 35 is uniformly in contact. Similarly, the entire surface of the contacting portion between the seal member 35 and the seal supporting member 103 is also uniformly in contact. Therefore, the force exerted to the seal supporting member 103 is equal at each portion, and accordingly, the seal supporting member 103 does not rotate.

On the other hand, where the developing roller 33 is continuously driven in the direction of the arrow B, the contacting surface between the developing roller 33 and the seal member 35 roughens to result in increase of the frictional resistance between the developing roller 33 and the seal member 35, and accordingly, the density in the seal member 35 increases. Thus, the seal supporting member 103 rotates in the direction of the arrow E about the shaft 107 by a force exerted by the seal member 35. Therefore, where the frictional resistance between the developing roller 33 and the seal member 35 increases, the developing apparatus can prevent increase in the reaction force exerted by the seal supporting member 103 to the seal member 35, and also can uniformly maintain the seal member 35 and the seal supporting member 103.

The developing apparatus according to the second embodiment of the present invention can control the reaction force exerted by the seal member 35 to the developing roller 33 even where the frictional resistance between the seal member 35 and the developing roller 33 increases, and thus, a increase in frictional force between the developing roller 33 and the seal member 35 can be prevented. Therefore, the developing apparatus can prevent the developer from leaking from between the developing roller 33 and the seal member 35 due to deformation of the seal member 35.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A developing apparatus comprising:

a developer container for containing a developer;

a developing portion for generating a developer image by developing an electrostatic latent image formed on an electrostatic latent image holder using the developer contained in the developer container;

a seal member formed along a surface of an end portion of the developing portion for sealing between the developer container and the developing portion;

wherein each end of the seal member is fixed; and a supporting member for supporting the seal member so as to allow displacement, wherein the supporting member includes a first supporting portion in contact with the seal member at an upstream side in the rotational direction of the developing portion, and a second supporting portion formed with an elastic material in contact with the seal member at a downstream side in the rotational direction of the developing portion, the first and second supporting portions urging the seal member towards the developing portion.

2. The developing apparatus according to claim 1, wherein the developing portion is a developing roller.

3. The developing apparatus according to claim 1, wherein the developing portion is a developing belt.

4. The developing apparatus according to claim 1, wherein the supporting member supports the seal member so as to be able to displace the seal member in a direction away from a rotational center of the developing portion.

5. The developing apparatus according to claim 4, wherein the seal member is supported to be able to move in a rotational direction of the developing portion.

6. The developing apparatus according to claim 1, wherein the seal member is an urethane sponge.

7. The developing apparatus according to claim 1, wherein the seal member has a friction reduction film adhered to a surface of the seal member in contact with the developing portion.

8. The developing apparatus according to claim 1, wherein the supporting member is formed to have a curvature corresponding to a shape of the developing portion.

9. An image forming apparatus comprising:

the developing apparatus according to claim 1;

a transfer device for transferring the developer image developed by the developing apparatus onto a predetermined recording medium; and a fusing device for fusing the developer image transferred to the recording medium by the transfer device to fix the developer image to the recording medium.

10. A developing apparatus comprising:

a developer container for containing a developer;

a developing portion for generating a developer image by developing an electrostatic latent image formed on an electrostatic latent image holder using the developer contained in the developer container;

a seal member formed along a surface of an end portion of the developing portion for sealing between the developer container and the developing portion; and a supporting member for supporting the seal member so as to allow displacement, the supporting member having an assisting sponge pressed by a surface of the seal member opposite to a portion of the seal member in contact with the developing portion, and a supporting base fixed to the developer container and supporting the assisting sponge.

11. The developing apparatus according to claim 10, wherein a resilience of the assisting sponge is less than a resilience of the seal member.

12. The developing apparatus according to claim 10, wherein the supporting base has a recess portion accommodating the assisting sponge that is compressed.

13. The developing apparatus according to claim 10, wherein the assisting sponge takes up approximately two thirds of a downstream side, in a rotational direction of the developing portion, of a surface of the supporting member facing the seal member.

14. An image forming apparatus comprising:

the developing apparatus according to claim 10;

a transfer device for transferring the developer image developed by the developing apparatus onto a predetermined recording medium; and a fusing device for fusing the developer image transferred to the recording medium by the transfer device to fix the developer image to the recording medium.

15. A developing apparatus comprising:

a developer container for containing a developer;

a developing portion for generating a developer image by developing an electrostatic latent image formed on an electrostatic latent image holder using the developer contained in the developer container;

a seal member formed along a surface of an end portion of the developing portion for sealing between the developer container and the developing portion; and a supporting member for supporting the seal member so as to allow displacement, the supporting member being formed to be able to rotate about an axis generally parallel to a rotational axis of the developing portion.

16. The developing apparatus according to claim 15,wherein the axis of the supporting member is formed at a generally middle of a portion of a circumference of the developing portion corresponding to a portion in which the supporting member and the seal member are in contact with each other.

17. An image forming apparatus comprising:

the developing apparatus according to claim 15;

a transfer device for transferring the developer image developed by the developing apparatus onto a predetermined recording medium; and a fusing device for fusing the developer image transferred to the recording medium by the transfer device to fix the developer image to the recording medium.

18. A developing apparatus comprising:

a developer container for containing a developer;

a developing portion for generating a developer image by developing an electrostatic latent image formed on an electrostatic latent image holder using the developer contained in the developer container;

a seal member formed along a surface of an end portion of the developing portion for sealing between the developer container and the developing portion; and a supporting member for supporting the seal member so as to allow displacement, the supporting member being in contact with a surface of the seal member opposite to a portion of the seal member in contact with the developing portion, and the supporting member is a spring formed to press the seal member against the developing portion.

19. An image forming apparatus comprising:

the developing apparatus according to claim 18;

a transfer device for transferring the developer image developed by the developing apparatus onto a predetermined recording medium; and a fusing device for fusing the developer image transferred to the recording medium by the transfer device to fix the developer image to the recording medium.

* * * * *